US007227436B2

(12) United States Patent
Wieger et al.

(10) Patent No.: US 7,227,436 B2
(45) Date of Patent: Jun. 5, 2007

(54) MODULAR REED SWITCH ASSEMBLY AND METHOD FOR MAKING

(75) Inventors: George S. Wieger, Niles, MI (US); Hugo N. Decampos, Granger, IN (US); Edward J. Zielinski, Cincinnati, OH (US)

(73) Assignee: Honeywell International Inc., Morris Township, NJ (US)

( * ) Notice: Subject to any disclaimer, the term of this patent is extended or adjusted under 35 U.S.C. 154(b) by 573 days.

(21) Appl. No.: 10/794,708

(22) Filed: Mar. 5, 2004

(65) Prior Publication Data

US 2005/0151608 A1 Jul. 14, 2005

Related U.S. Application Data

(62) Division of application No. 10/150,247, filed on May 17, 2002, now Pat. No. 6,729,016.

(60) Provisional application No. 60/327,246, filed on Oct. 5, 2001.

(51) Int. Cl.
*H01H 1/66* (2006.01)

(52) U.S. Cl. ..... 335/151; 335/205

(58) Field of Classification Search ..... 335/205–207, 335/151–154

See application file for complete search history.

(56) References Cited

U.S. PATENT DOCUMENTS 3,664,014 A * 5/1972 Peroni et al. ..... 29/622
4,943,791 A * 7/1990 Holce et al. ..... 335/153
5,438,869 A * 8/1995 Mueller et al. ..... 73/431
5,969,244 A * 10/1999 Machado ..... 73/431

* cited by examiner

*Primary Examiner*—Elvin Enad
*Assistant Examiner*—Bernard Rojas
(74) *Attorney, Agent, or Firm*—Birch, Stewart, Kolasch & Birch, LLP

(57) ABSTRACT

A modular reed switch assembly and method for making the same are provided. A switch assembly (101) includes a reed switch (206, 106) that is enclosed between a primary reed switch cover (208) and a reed switch base (104) wherein the reed switch cover and reed switch base are recessed to accommodate the reed switch. A secondary reed switch cover (102) further covers the primary reed switch cover (208) and the secondary reed switch cover (102) connects with the reed switch base (104). A protrusion (106) provides access to the electrical contacts (302) of the reed switch (206, 106) through the primary reed switch cover (208) and secondary reed switch covers (102).

16 Claims, 3 Drawing Sheets

MODULAR REED SWITCH ASSEMBLY AND METHOD FOR MAKING

RELATED APPLICATION

This application is a divisional of application Ser. No. 10/150,247 filed May 17, 2002 now U.S. Pat. No. 6,729,016, which application claims priority under 35 U.S.C §119(e) of Provisional Application No. 60/327,246 filed on Oct. 5, 2001, the entire contents of which are herein incorporated by reference.

FIELD OF THE INVENTION

The invention relates to switch assemblies. More particularly, a modular reed switch assembly and method for making utilizes a compliant material that is able to dampen vibrations seen by the reed switch. This helps reduce reed switch failures due to high vibration levels and other environmental factors.

BACKGROUND OF THE INVENTION

There are many commercial and military applications of reed switches. One specific application is the use of a reed switch to provide valve position feedback information on aircraft. However, a known problem with reed switches is a predisposition towards failing in the high vibration environments that aircraft encounter during operations. Rotating equipment such as motors, engines, actuators and gearing can all generate vibrations and introduce other harmonic disturbances that can cause numerous problems with reed switches and cause them to fail. Deleterious consequences such as switch bounce and hot latching are very environmentally sensitive phenomena, where small changes in response characteristics or differing vibration inputs can significantly affect ultimate performance.

One particular application of the reed switch is to provide a positive indication of the status (e.g., open or closed) of a fuel valve that regulates the flow of fuel to an engine. If mechanical latching or sticking occurs between the electrical contacts of a reed switch, an indicator may yield a faulty reading indicating a disagreement or mismatch between an intended command and a valve position.

Therefore, it is desirable to have a reed switch assembly that can operate in hostile environments and eliminate or reduce the harmful effects of the operational environment, such as vibration, upon reed switch operation.

SUMMARY OF THE INVENTION

In accordance with the present invention, the deficiencies in prior systems are overcome by providing an improved modular reed switch assembly and a method for making the same.

A modular reed switch assembly includes a reed switch that is enclosed between a secondary reed switch cover and a reed switch base. The reed switch base is recessed to accommodate the reed switch. The reed switch is further enclosed between a primary reed switch cover and a main housing wherein the primary reed switch cover and the main housing are recessed to accommodate the switch assembly containing the reed switch. A protrusion provides access to the electrical contacts of the reed switch through the primary and secondary reed switch covers.

The secondary reed switch cover and the reed switch base snap together around the reed switch. The mating surfaces of the secondary reed switch cover and the reed switch base snap together and form an integrated whole surrounding the reed switch. The material used to enclose the reed switch is compressed upon installation around the reed switch. The material used to enclose the reed switch is a compliant material and has a durometer rating. The material selected can be Viton® or Fluorosilicone®. The material used, as well as any rubber used, yields durometer value (D) ranges from a high value of about 75D average to a low value of about 55D average.

BRIEF DESCRIPTION OF THE DRAWINGS

A more complete understanding of the present invention will become apparent from the following description taken in conjunction with the accompanying drawings, wherein.

DETAILED DESCRIPTION OF THE PREFERRED EMBODIMENTS

Aspects of the invention are disclosed in the accompanying description with reference to the attached figures.

Figure 1:
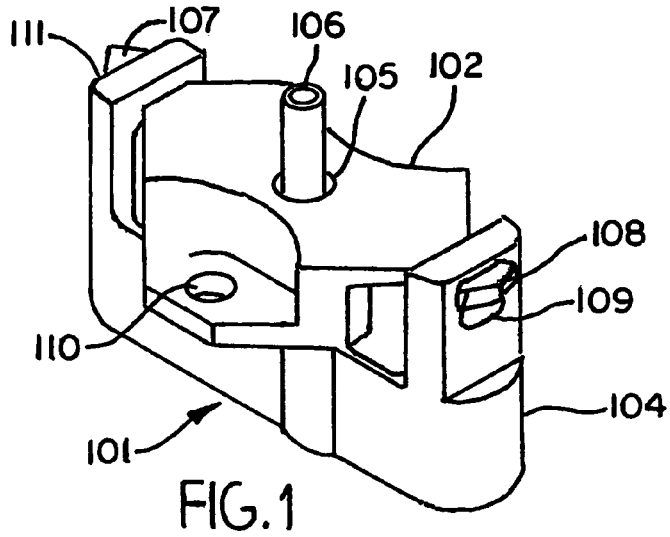
FIG. 1 is a schematic illustration of a perspective view of the reed switch assembly prior to mounting in the main housing.

One embodiment of the present invention is shown in FIG. 1. In FIG. 1, a reed switch assembly 101 is shown prior to mounting of the reed switch assembly in the main housing. A secondary reed switch cover 102 fits over a reed switch base 104. The secondary reed switch cover 102 fastens together with the reed switch base 104 in a snap together manner, with interlocking tabs 107 and 108 snapping into slots 109 and 111 respectively. Those skilled in the art will realize that other fastening mechanisms can be used to fasten the components together.

Figure 2:
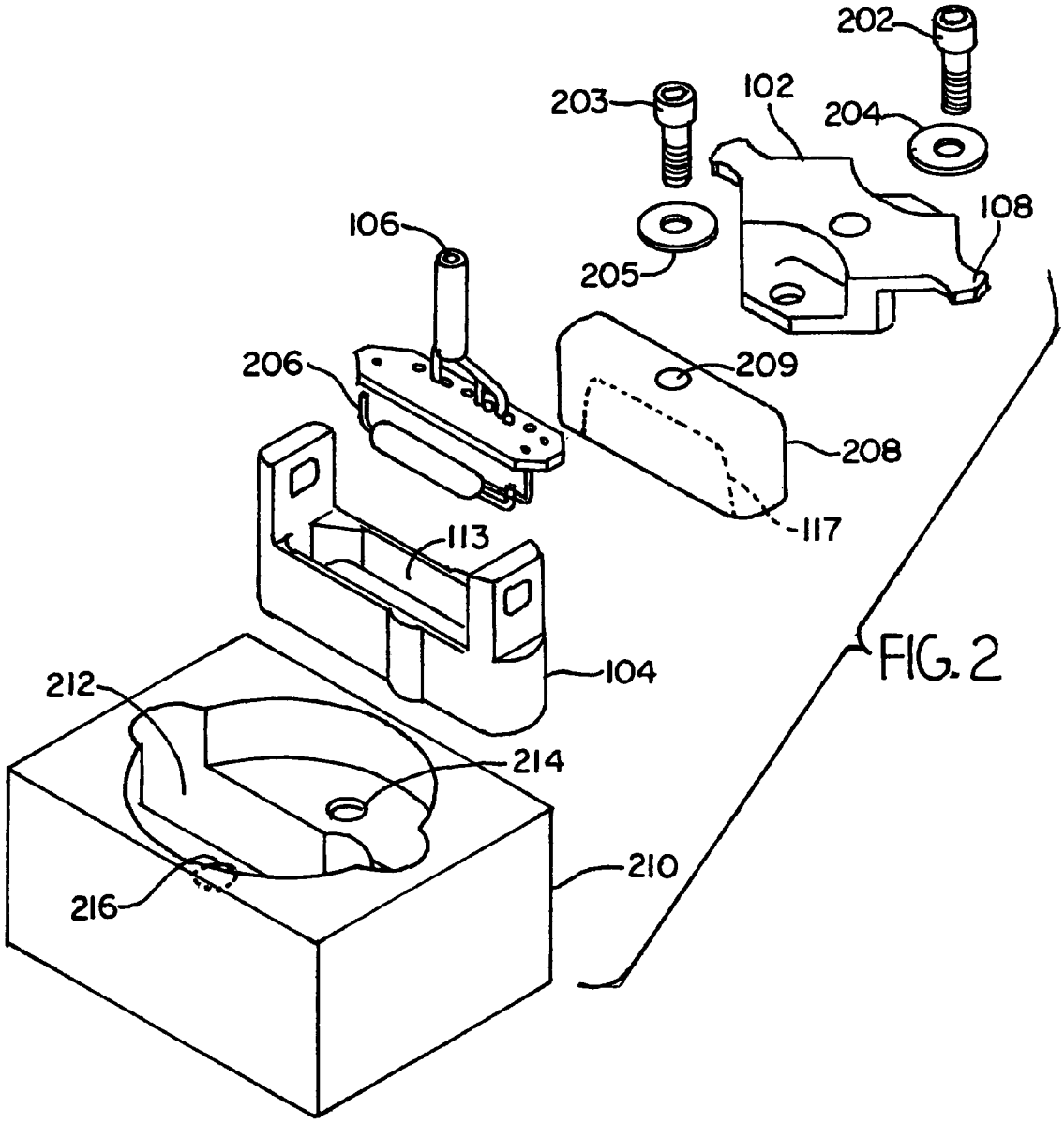
FIG. 2 is an exploded view of the switch of FIG. 1 and how it interfaces with the main housing to form the integrated modular reed switch assembly.
Figure 3:
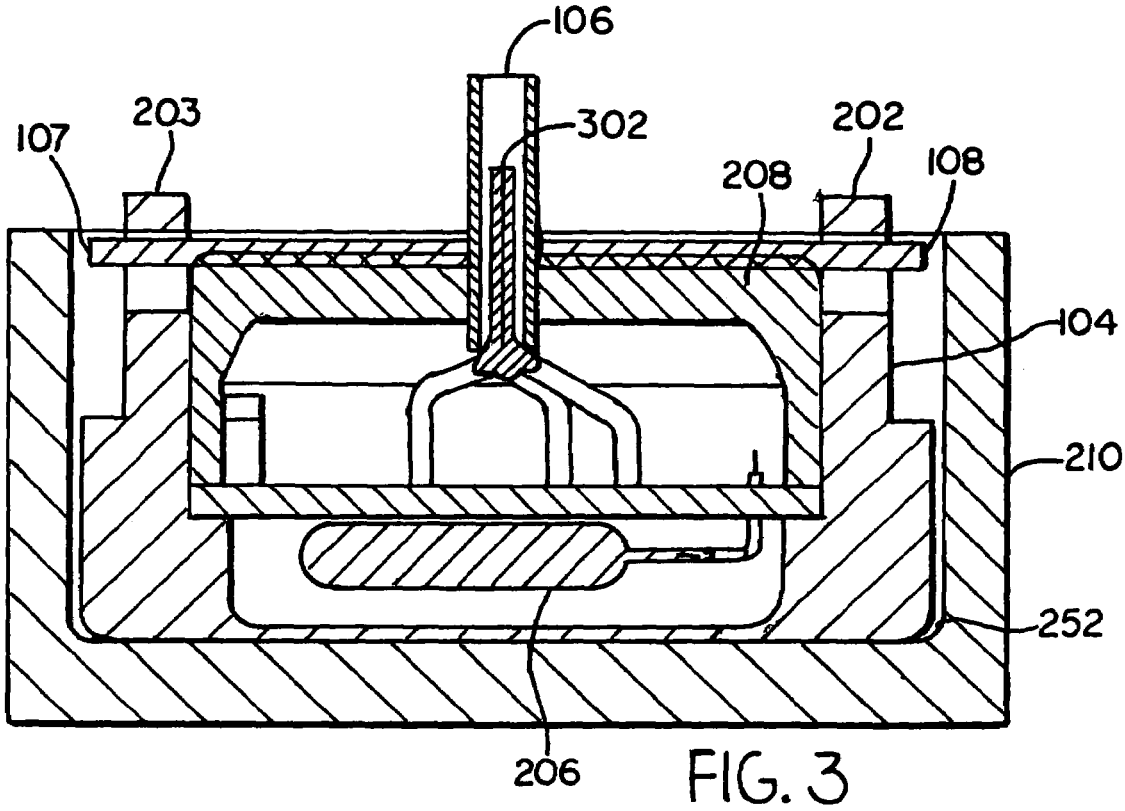
FIG. 3 is a sectional view of the modular reed switch assembly.
Figure 4:
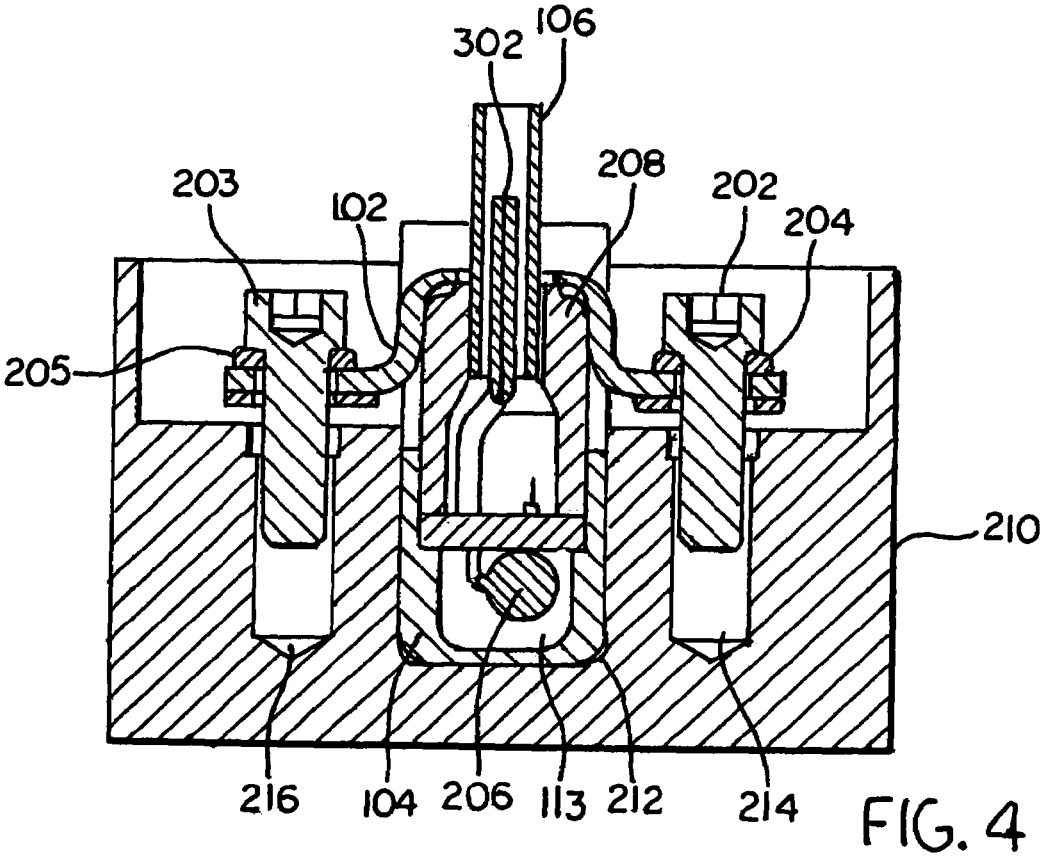
FIG. 4 is another sectional view of the modular reed switch assembly.

In FIG. 1, 110 represents an opening through the secondary reed switch cover 102 through which a fastener can be inserted through the opening and connecting the secondary reed switch cover 102 to a main housing 210 that is shown in FIG. 2. A hole 105 in the secondary reed switch cover 102 allows a protrusion 106 to pass through so that the electrical connectors connecting with the reed switch may be routed through this protrusion as it passes through the secondary reed switch cover 102. In this embodiment, the reed switch is considered to include the reed switch 206, the circuit board, the electrical connectors and the protrusion 106 that the connectors to the reed switch pass through. This protrusion 106 is part of the reed switch 206 and is shown in FIG. 2. The reed switch itself cannot be seen in FIG. 1. However, the specific location and orientation of the reed switch 206 is shown in FIGS. 2, 3 and 4.

The secondary reed switch cover 102 and the reed switch base 104 can be made from any materials that possess good vibration dampening and isolation capabilities. Another consideration is the compressibility of the material selected, because it is this material characteristic that will help to secure and seat the reed switch. Upon the installation of the reed switch 206 between the secondary reed switch cover 102 and the reed switch base 104, the material that makes up the secondary reed switch cover 102 and the reed switch base 104 compresses around the reed switch 206 to secure the switch and provide vibration damping characteristics.

One exemplary embodiment of the present invention can use rubber as this vibration dampening material. Any type of aerospace grade rubbers can be used to form the secondary reed switch cover 102 and the reed switch base 104. Specific examples of appropriate materials are Viton® and Fluorosilicone®. Materials with a higher durometer rating are especially well suited for implementing the present invention. Favorable results have been achieved with materials and rubbers yielding durometer value (D) ranges from a high value of about 75D average to a low value of about 55D average. The specific design application and anticipated operational environment, such as vibration levels, are factors to consider when selecting an appropriate durometer rating for a material used to enclose a reed switch operating under the vibration levels encountered during a given operational scenario.

The switch assembly shown in FIG. 1 is fastened with a main housing 210 shown in FIG. 2 and comprises the modular reed switch assembly.

In FIG. 2, the reed switch 206 is shown in relation to the reed switch base 104 and a primary reed switch cover 208. The reed switch base 104 has a recess 113 where the reed switch 206 is set into. The primary reed switch cover 208 has a recess 117 that surrounds and encloses the top of the reed switch 206. Incidentally, magnetically actuated reed switches are well known to those skilled in the art and therefore a detailed description of the reed switch itself and its construction will not be provided.

The primary reed switch cover 208 also has a hole 209 in the top to allow the protrusion 106 to pass through it to provide an opening for the electrical connectors of the reed switch 206 to pass through and provide connectivity and access to the interior of the switch assembly. The reed switch base 104 then fits into a recess 212 in the main housing 210. There should be no gap between the reed switch base 104 and the main housing 210 that requires shimming. However, if the tolerances between the surfaces are such that a gap does exist, then a shim(s) can be used to maintain a maximum force margin between the reed switch base 104 and the main housing 210.

The secondary reed switch cover 102 fits over the protrusion 106 and is then fastened down onto the main housing 210 using fasteners 202, 203, and washers 204 and 205. The fasteners fasten into the holes 214 and 216 shown in the main housing 210.

In FIG. 3, a sectional view of the modular reed switch assembly is shown. The reed switch 206 is located between the primary reed switch cover 208 and the reed switch base 104. The switch assembly 101 fits into a recess 212 located in the main housing 210. Fasteners 202 and 203 fasten together the switch assembly with the main housing 210. Electrical connectors 302 of the reed switch 206 are shown passing through the protrusion 106. As mentioned earlier; this protrusion provides the electrical connection means between the switch and an external device connected to the switch enclosed in the modular reed switch assembly.

In FIG. 4, another sectional view of the modular reed switch assembly is shown. The reed switch 206 is enclosed between the primary reed switch cover 208 and the reed switch base 104. This portion of the switch assembly 101 fits into a recess 212 located in the main housing 210. Fasteners 202, and 203, and washers 204 and 205 fasten together the switch assembly with the main housing 210. These fasteners fasten into two holes 214 and 216 located on the main housing 210. Electrical connectors 302 of the reed switch 206 are shown passing through the protrusion 106. Again, this protrusion (the protrusion 106 is actually a protective sleeving, the conductors, 302, provide the electrical connection) provides the electrical connection means between the switch and an external device connected to the switch encased in the modular reed switch assembly.

Those skilled in the art will realize that there are various combinations of materials that may be used to construct the modular reed switch assembly. Factors such as the vibration environment, reed surfaces and performance history should all be considered when evaluating a design.

Figure 5:
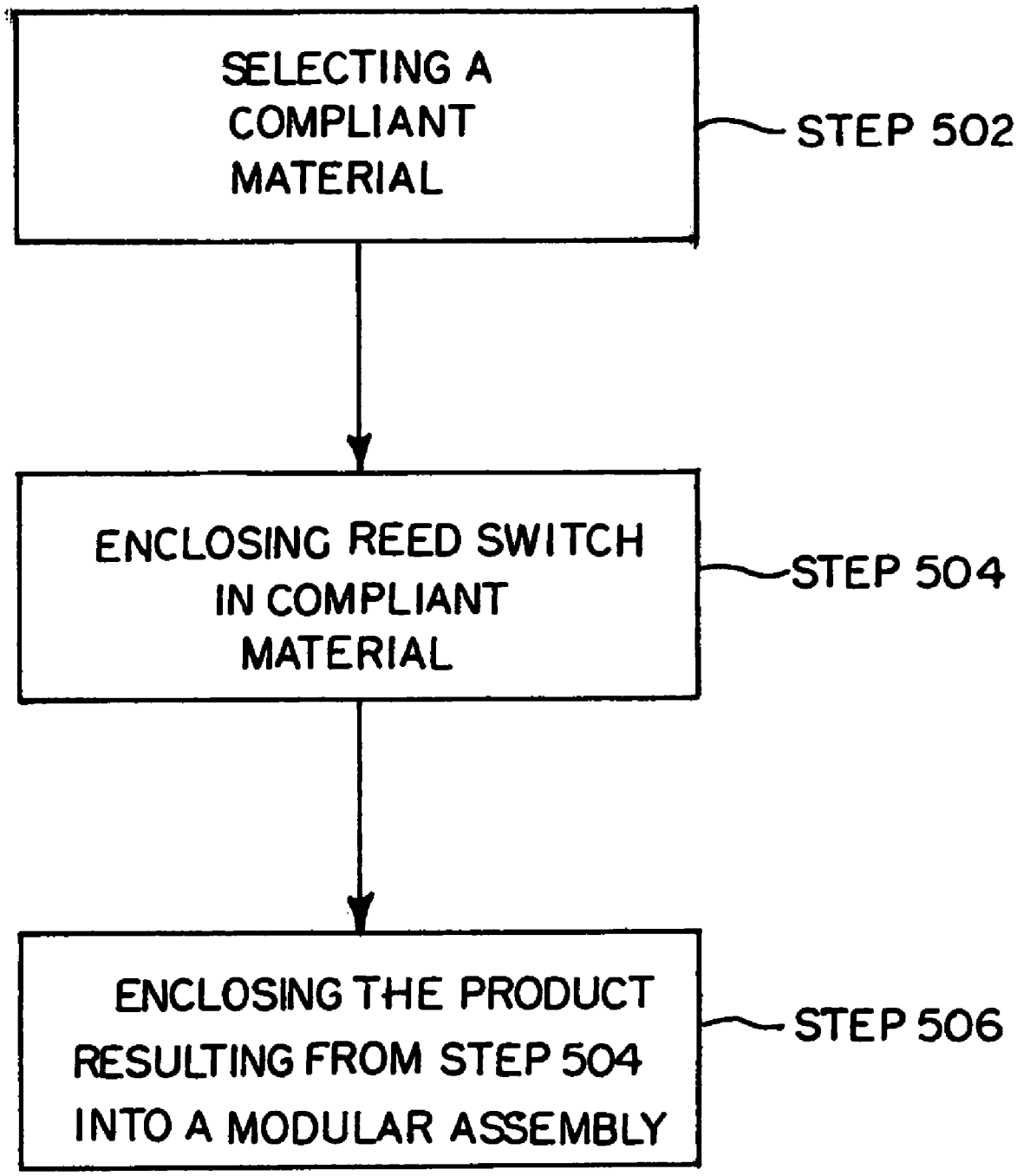
FIG. 5 is a flow diagram of a method for making the reed switch assembly.

According to another embodiment of the present invention, a method of making the aforementioned modular reed switch assembly is also described. FIG. 5 depicts a flow diagram showing a method for making the reed switch assembly. In step 502 a compliant material is selected to enclose a reed switch. In step 504, the reed switch is enclosed in the compliant material that was selected in step 502. In step 506, the product that resulted from step 504 (a reed switch enclosed in a compliant material) is further enclosed into a modular assembly.

More particularly, a reed switch 206 is mounted between a primary reed switch cover 208 and a reed switch base 104. Both the primary reed switch cover 208 and the reed switch base 104 have recesses that have been hollowed out to accommodate and enclose the reed switch 206. The material selected for the cover and the base should be compressible and compliant. This forms a secure mount for the enclosed reed switch. This switch assembly 101 is then seated in a recess of a main housing 210 and covered by a secondary reed switch cover 102. Both the primary reed switch cover 208 and secondary reed switch cover 102 provide access for connecting an external device to the electrical connectors 302 of the reed switch 206.

The secondary reed switch cover 102 and the reed switch base 104 snap together around the reed switch 206. The mating surfaces of the secondary reed switch cover 102 and the reed switch base 104 snap together and form an integrated whole surrounding the reed switch 206. The present invention can be used with or without shims to provide optimum compression of the compliant material. An optimum compression is one that best achieves a desired objective given a set of operational, environmental and design constraints. The material used to enclose the reed switch is compressed upon installation around the reed switch. The material used to enclose the reed switch is a compliant material and has a durometer rating. The material used to enclose the reed switch can be an aerospace grade material.

What is claimed is:

1. A modular reed switch assembly comprising:

a switch assembly including a reed switch that is enclosed between a primary reed switch cover and a reed switch base wherein said primary reed switch cover and said reed switch base are recessed to accommodate the reed switch and a secondary reed switch cover further covers the primary reed switch cover and said secondary cover connects with said reed switch base;

a main housing wherein said secondary reed switch cover and said main housing enclose said reed switch; and wherein said main housing is recessed to accommodate said reed switch base and a protrusion of said switch assembly provides access to the electrical contacts of the reed switch through the primary and secondary reed switch covers.

2. The modular reed switch assembly of claim 1 wherein the secondary reed switch cover and the reed switch base snap together around the reed switch.

3. The modular reed switch assembly of claim 2 wherein the mating surfaces of the secondary reed switch cover and the reed switch base snap together and form an integrated whole surrounding the reed switch.

4. The modular reed switch assembly of claim 1 wherein a shim is used between the reed switch base and main housing to maintain optimum compression of a compliant material forming a secure mount for said reed switch.

5. The modular reed switch assembly of claim 1 wherein a shim is not used between the reed switch base and main housing to maintain optimum compression of a compliant material forming a secure mount for said reed switch.

6. The modular reed switch assembly of claim 1 wherein the material used to enclose the reed switch is compressed upon installation around the reed switch.

7. The modular reed switch assembly of claim 1 wherein the material used to enclose the reed switch is a compliant material.

8. The modular reed switch assembly of claim 1 wherein the material used to enclose the reed switch has an appropriate durometer rating for engine vibration levels.

9. The modular reed switch assembly of claim 1 wherein the material used to enclose the reed switch is an aerospace grade material.

10. The modular reed switch assembly of claim 1 wherein the material selected is rubber.

11. The modular reed switch assembly of claim 10 wherein the rubber has an appropriate durometer rating for engine vibration levels.

12. The modular reed switch assembly of claim 10 wherein the rubber selected is an aerospace grade rubber.

13. The modular reed switch assembly of claim 7 wherein the material is Viton.

14. The modular reed switch assembly of claim 7 wherein the material is Fluorosilicone.

15. The modular reed switch assembly of claim 7 wherein the material yields durometer value (D) ranges from a high value of about 75D average to a low value of about 55D average.

16. The modular reed switch assembly of claim 10 wherein the rubber yields durometer value (D) ranges from a high value of about 75D average to a low value of about 55D average.

* * * * *